US011635248B2

(12) United States Patent
Parnisari

(10) Patent No.: US 11,635,248 B2
(45) Date of Patent: Apr. 25, 2023

(54) BUILT-IN REFRIGERATOR

(71) Applicant: WHIRLPOOL CORPORATION, Benton Harbor, MI (US)

(72) Inventor: Matteo Parnisari, Cassinetta (IT)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 17/351,593

(22) Filed: Jun. 18, 2021

(65) Prior Publication Data

US 2022/0404089 A1 Dec. 22, 2022

(51) Int. Cl.
*F25D 23/02* (2006.01)

(52) U.S. Cl.
CPC ..... *F25D 23/028* (2013.01); *F25D 2323/02* (2013.01)

(58) Field of Classification Search
CPC ..... F25D 23/028; F25D 2323/02
USPC ..... 312/405
See application file for complete search history.

(56) References Cited

U.S. PATENT DOCUMENTS

| | | | | |
|---|---|---|---|---|
| 9,228,386 | B2 * | 1/2016 | Thielmann | E05F 15/00 |
| 10,677,512 | B1 * | 6/2020 | Contin | E05F 1/1016 |

FOREIGN PATENT DOCUMENTS

| | | | | |
|---|---|---|---|---|
| CN | 201874375 | U | 6/2011 | |
| CN | 205795320 | U | 12/2016 | |
| CN | 211524469 | U | 9/2020 | |
| DE | 7520916 | U | 11/1975 | |
| DE | 19704698 | A1 | 8/1998 | |
| EP | 565900 | A1 * | 10/1993 | E05D 3/04 |
| EP | 657609 | A1 * | 6/1995 | E05D 3/04 |
| EP | 0857929 | B1 | 5/2002 | |
| JP | 03274376 | * | 5/1991 | |
| JP | H03274376 | A | 12/1991 | |
| JP | 5010068 | * | 1/1993 | |
| WO | WO-2018133210 | A1 * | 7/2018 | A47B 81/00 |

* cited by examiner

*Primary Examiner* — Daniel J Troy
*Assistant Examiner* — Timothy M Ayres
(74) *Attorney, Agent, or Firm* — Brooks Kushman P.C.

(57) ABSTRACT

A built-in assembly comprises a refrigerator or freezer configured for installation in a piece of kitchen furniture having a front panel hinged to a cabinet structure. The front panel is arranged at the refrigerating appliance door and linked thereto by means of at least one sliding and connecting device which comprises a rail and a cursor, wherein at least one of the rail and cursor is fully interposed between the front panel and the refrigerating appliance door so that it is hidden from view in its installed configuration.

20 Claims, 4 Drawing Sheets

BUILT-IN REFRIGERATOR

TECHNICAL FIELD

The present disclosure relates to built-in appliances, such as a refrigerator, that are installed within a piece of furniture, such as a cabinet structure.

BACKGROUND

Appliances, such as refrigerators, may be installed inside of pieces of furniture, such as cabinet structures.

SUMMARY

A built-in assembly includes a refrigerating appliance, a piece of furniture, at least one first sliding and connecting device, and at least one second sliding and connecting device. The refrigerating appliance has a door. The piece of furniture has a cabinet structure and a front panel hinged to the cabinet structure. The cabinet structure is configured to receive the refrigerating appliance. The front panel is arranged adjacent to the door of the refrigerating appliance. The at least one first sliding and connecting device slidably secures the front panel to the door. The at least one first sliding and connecting device comprises a first rail element and a first sliding element. The at least one second sliding and connecting device slidably secures the front panel to the door. The at least one second sliding and connecting device comprises a second rail element and a second sliding element. The first rail element is substantially parallel with the second rail element. The first sliding element is substantially perpendicular to the second sliding element.

A built-in assembly includes a refrigerating appliance, a piece of furniture, and at least one sliding and connecting device. The refrigerating appliance has a door. The piece of furniture has a cabinet structure and a front panel hinged to the cabinet structure. The refrigerating appliance is configured for installation in the cabinet structure. The front panel is arranged adjacent to the door of the refrigerating appliance. The at least one sliding and connecting device comprises a rail element and a sliding element. The sliding element has (i) a first flat portion configured to be fastened to a vertical side edge of the refrigerating appliance door and (ii) a second flat portion configured to cooperate with the rail element. The second flat portion is fully interposed between the door and the front panel such that it is hidden from view.

A built-in assembly includes a refrigerating appliance, a piece of furniture, and at least one sliding and connecting device. The refrigerating appliance has a door. The piece of furniture has a cabinet structure and a front panel hinged to the cabinet structure. The refrigerating appliance is configured for installation in the cabinet structure. The front panel is arranged adjacent to the door of the refrigerating appliance. The at least one sliding and connecting device has a rail element and a sliding element. The at least one sliding and connecting device is configured to slidably secure the front panel to the door. The sliding element has a first flat portion and a second flat portion. The first flat portion is configured to be fastened to a horizontal edge or a vertical side edge of the refrigerating appliance door. The second flat portion has a first C-shaped cross section hollow profile and a second C-shaped cross section hollow profile each configured to engage and slide along a matching H-shaped cross section profile formed on the rail element.

The present invention relates to a refrigerating built-in appliance configured for installation in a piece of kitchen furniture having a front panel hinged to a cabinet structure. The front panel is typically arranged frontally at a door of the refrigerating appliance and connected thereto by way of at least a sliding and connecting device which comprises a rail element and a sliding element.

In the above kind of appliances the sliding and connecting device is installed between the door of the appliance and the front panel of a piece of furniture containing the household appliance, such panel being a door of the furniture niche.

According to such known technique it is possible to use both hinges, i.e. the hinge of the built-in appliance door and the hinge of the furniture front panel, without the need of using expensive special hinges having several axis of rotation.

For practical and aesthetical reasons, the two "doors", i.e. door of appliance and the panel/door of the piece of furniture, should remain as close to each other as possible during opening and closing, when there is a lateral shift between the two doors due to the two different vertical axis of hinges.

EP857929 discloses a built-in refrigerator in which a sliding element is installed on the vertical side of an appliance door, and a rail element is installed on a front panel of a piece of furniture configured to accommodate the built-in refrigerator, so that one of its ends protrudes from the sliding element during the entire rotation of the front panel which draws the appliance door. Therefore, for all possible positions of the front panel and door, both components of the sliding and connecting device are at least partially visible by the user when he/she opens the door of the appliance.

The same considerations apply to the solution shown in DE4200333A1 where a rail element is fastened to an upper side of an appliance door and a sliding element is fastened to a front panel of a piece of furniture configured to accommodate the built-in refrigerator.

Despite robustness and reliability of known sliding and connecting devices of the type above, they are generally perceived as cheap solutions due to their visibility to users when opening and closing the door of a refrigerator appliance.

Moreover, rail elements are typically provided with a removable plastic cover that conceals the screws used for fastening such element. During use of the appliance and in view of the position of the rail element near the vertical edges of the doors restrained to each other, such cover can be accidentally detached, increasing the low perceived quality of the device. The color of the material forming the rails may also fade over time further increasing the low perceived quality of the device.

For these reasons, direct connection of furniture panels to refrigerator doors is more and more used by manufactures of kitchen furniture. However, this solution is far more expensive and complex than sliding and connecting devices. Hence, a need exists to improve sliding and connecting devices for refrigerator built-in appliances.

To this end, this disclosure relates to a built-in appliance where at least one of the rail element and slide element is fully interposed between the front panel and the refrigerating appliance door so that it is hidden from view in the installed configuration.

According to a first aspect of the invention, the sliding element has a first flat portion configured to be fastened to a horizontal side of the refrigerating appliance door and a second portion configured to slide on the rail element fastened to the front panel. In this aspect the rail element is fully hidden by the appliance door in any positions thereof.

According to a further aspect of the invention, the first flat portion is configured to be fastened to a vertical side of the refrigerating appliance door and the second portion is configured to slide on the rail element fastened to the front panel.

According to a further aspect, the sliding element is L-shaped and one portion is fully interposed between the front panel and the refrigerating appliance door so that it is hidden from view.

According to a further aspect, the door of the refrigerating appliance presents a seat for the first flat portion of the sliding element so that said flat portion is substantially flush with the door.

According to a further aspect, both the sliding element and the rail element are fully interposed between the front panel and the refrigerating appliance door so that they are hidden from view in the installed configuration.

Further technical features and advantages of the invention will be clear in the following description, which is provided as a non-limiting example, with reference to the accompanying drawings.

DETAILED DESCRIPTION

Figure 1:
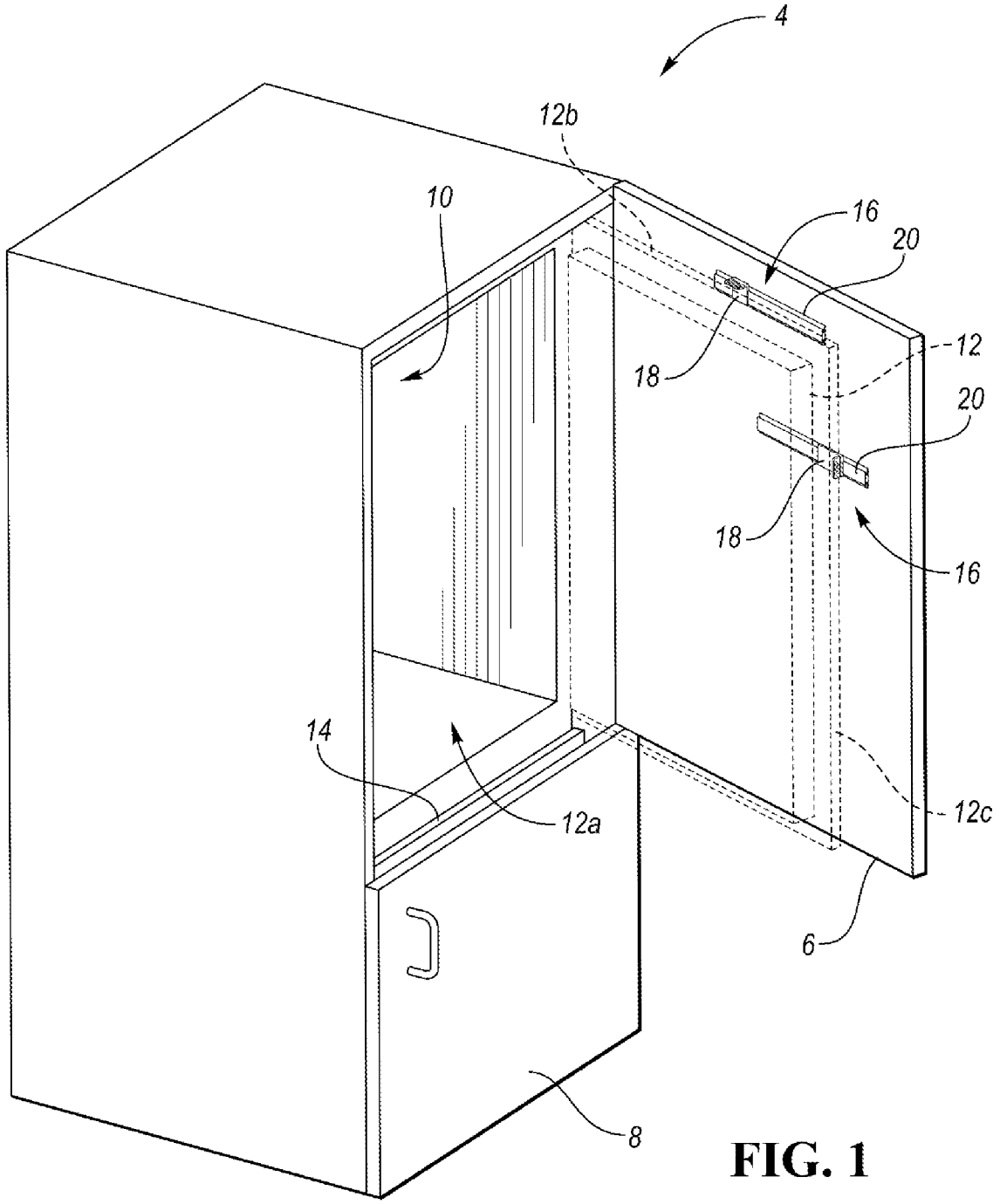
FIG. 1 is a perspective view of a built-in appliance according to a first embodiment of the invention, with a door in an open configuration.
Figure 2:
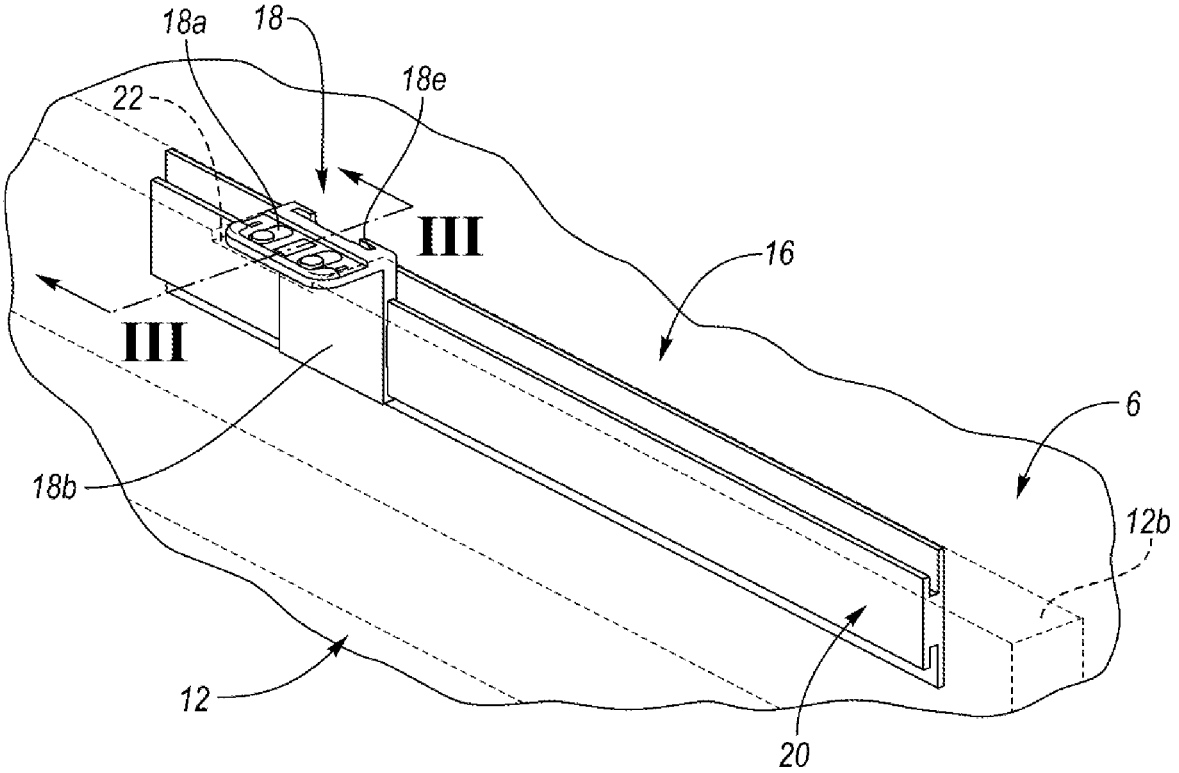
FIG. 2 is an enlarged view of a detail of FIG. 1.

Embodiments of the present disclosure are described herein. It is to be understood, however, that the disclosed embodiments are merely examples and other embodiments may take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures may be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

The indications "upper", "lower", "top", "front", "bottom", "floor", "horizontal", "vertical" and the like refer to the positions and orientations of the household appliance in its intended use position with respect to an observer located in front of the household appliance.

With reference to the drawings, 4 indicates a kitchen piece of furniture having an upper front panel 6 and a lower front panel 8 (for instance wooden panels or the like), both hinged to the piece of furniture 4 along a vertical axis and acting as doors of the piece of furniture 4. Inside the piece of furniture 4 a built-in refrigerating appliance 10 (shown only schematically in the drawings) having an upper door 12 for closing a refrigeration compartment 12*a* and a lower door 14 for closing a freezer compartment is inserted.

Between each panel 6 and 8 of the piece of furniture 4 and each door 12 and 14 of the appliance 10 one or more sliding and connecting devices 16, comprising a sliding element, or cursor, 18 and a rail 20, is interposed. The sliding and connecting device 16 disposed along the top of the door 12 in FIG. 1 is arranged in a first configuration while the sliding and connecting device 16 disposed along the side of the door 12 in FIG. 1 is arranged in a second configuration. The door 12 is illustrated in hidden lines in some of the Figures so that the components of the sliding and connecting device 16 are visible. However, it should be understood that the door 12 may not be hidden although illustrated in hidden lines. Reference will be made in the following to door 12 and panel 6. It goes without saying that the same considerations apply, mutatis mutandis, to door 14 and panel 8.

With reference to FIGS. 1-3 and 6, the sliding and connecting device 16 that is arranged in the first configuration is illustrated. Sliding element 18 is L shaped and has a first flat portion 18*a* fastened to an upper horizontal edge 12*b* of the appliance door 12 and a second flat orthogonal portion 18*b* on which a first hollow profile 18*c* having a C-shaped cross section is formed. The rail 20 is fastened on a rear surface of the front panel 6 and features a H-shaped cross section configured to match and engage the C-shaped cross section of the first hollow profile 18*c*. The sliding element 18 is fastened to the door 12 at a predetermined position, for instance in a seat 22 defined in the upper edge of the door so that the first flat portion 18*a* may be substantially flush with such upper edge 12*b*. Fastening screws (not shown) are inserted in openings 18*d* of the first flat portion 18. Moreover, the first flat portion 18*a* has a seat 19 where a flat plug (not shown) can be mounted e.g. by snap-fitting in order to hide the screw heads and the openings 18*d*. The rail element 20 is fastened to the panel 6 or 8 by means of screws, and for its correct initial positioning a self-adhesive tape (not shown) may be used during the assembly of the built-in appliance.

Alternatively, the sliding element 18 may be fastened to the door 12 also by using its second vertical portion 18*b* which, in this case, will be provided with holes (not shown) for fastening screws.

Figure 3:
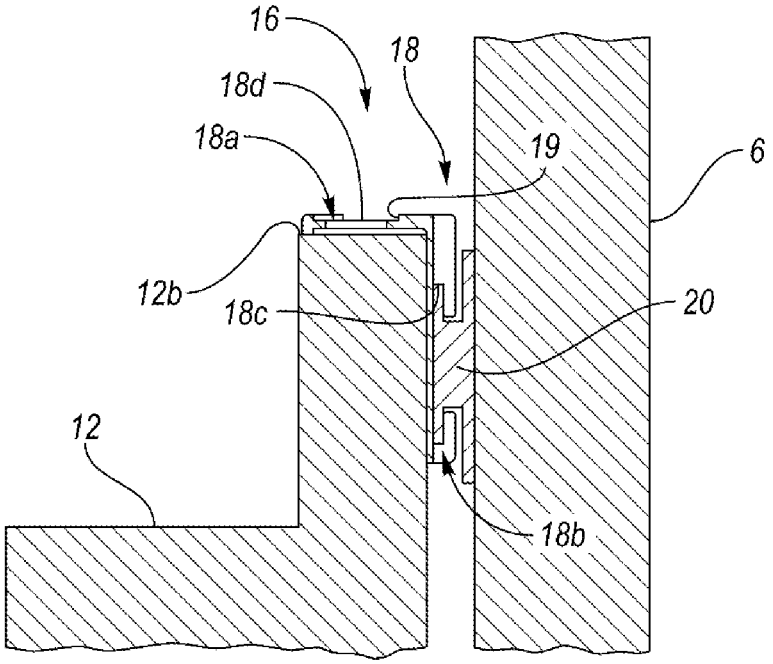
FIG. 3 is a cross-sectional view taken along line in FIG. 2.
Figure 4:
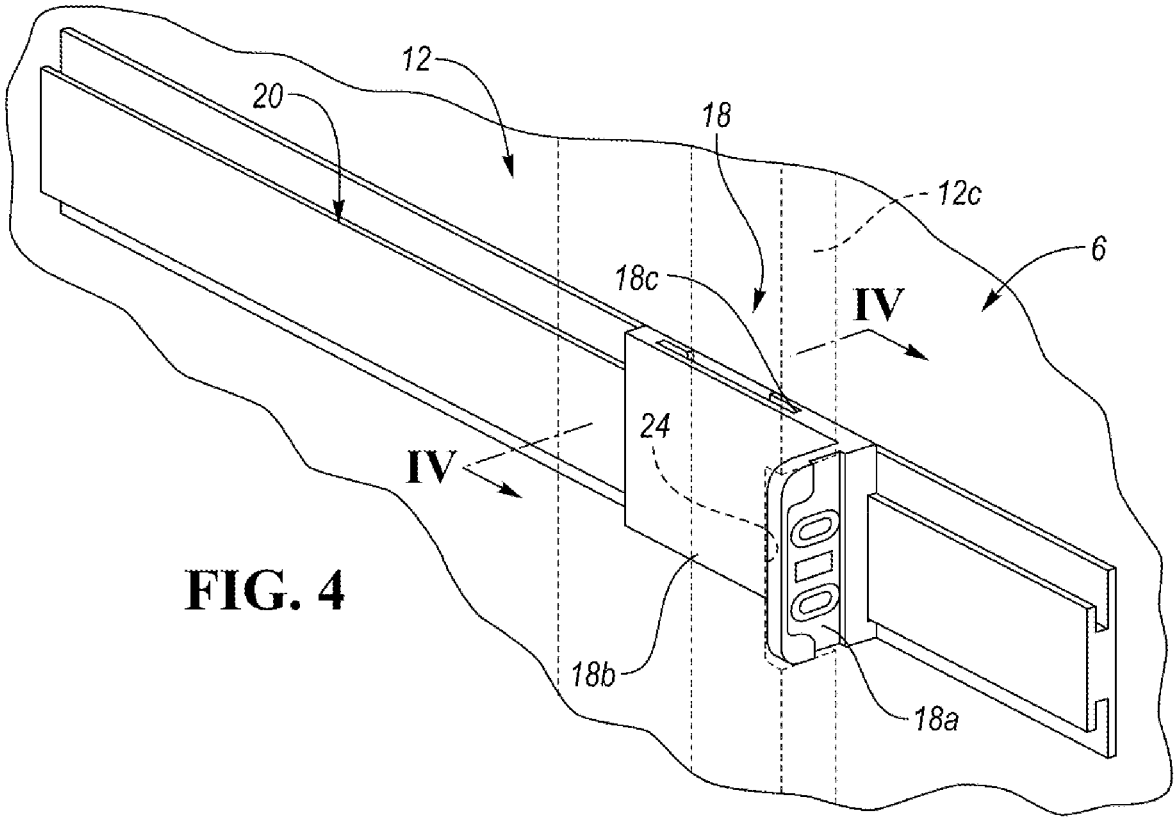
FIG. 4 is an enlarged view of a detail of FIG. 1.

The shape and dimensions of the sliding element 18 (as indicated in FIG. 3) are such that the rail 20 on which it slides is completely interposed between the panel 6 and the door 12 of the appliance, so that in any position of such door 12 during its opening and closing movement, it is totally invisible to the user. What the user can see is only the first flat portion 18*a* of the sliding element 18, which is small and placed in a seat of the upper edge of the door, so that its visibility is very low.

The same kind of sliding connection between the panel and the door of the appliance can be used for the lower panel 8 (freezer) as well. Of course, some variants of this system can be adopted, for instance the sliding and connecting device 16 can be positioned at the lower edge of the door 12, or additional sliding devices 16 can be used for horizontal edges of the door 12 (e.g., the second configuration of the sliding and connecting device 16). Also, the shape of the sliding element 18 and of the rail element 20 can be different from what shown in the drawings, and the cross section of the rail 20 can be different from the H shape shown in the drawings, for instance it could have a simple T-shaped cross section. Also, the fastening means of the rail element 20 to the panels 6 and 8 could be different from screws. Alternatively, the rail element 20 could be glued to the panel.

With reference to FIGS. 1 and 4-6, the sliding and connecting device 16 that is arranged in the second configuration is illustrated. The sliding and connecting device 16 that is arranged in the second configuration has all of the attributes as the sliding and connecting device 16 that is arranged in the first configuration and vice versa. However, the L shaped sliding element 18 of the sliding and connecting device 16 that is arranged in the second configuration is oriented at angle that is substantially perpendicular relative to the L shaped sliding element 18 of the sliding and connecting device 16 that is arranged in the first configuration. Substantially perpendicular may refer to any incremental angle that is between exactly perpendicular and 10° from exactly perpendicular.

Sliding element 18 is L shaped and has a first flat portion 18*a* fastened to a vertical side edge 12*c* of the appliance door 12 and a second flat orthogonal portion 18*b* on which a second hollow profile 18*e* having a C-shaped cross section is formed. The first hollow profile 18*c* and the second hollow profile 18*e* are substantially perpendicular to each other. Substantially perpendicular may refer to any incremental angle that is between exactly perpendicular and 10° from exactly perpendicular. The rail 20 is fastened on a rear surface of the front panel 6 and features a H-shaped cross section configured to match and engage the C-shaped cross section of the second hollow profile 18*e*. The rail 20 of the sliding and connecting device 16 that is arranged in the second configuration is substantially parallel to the rail 20 of the sliding and connecting device 16 that is arranged in the first configuration. Substantially parallel may refer to any incremental angle that is between exactly parallel and 10° from exactly parallel. The sliding element 18 is fastened to the door 12 at a predetermined position, for instance in a seat 24 defined in the vertical side edge of the door so that the first flat portion 18*a* may be substantially flush with such vertical side edge 12*c*. Fastening screws (not shown) are inserted in openings 18*d* of the first flat portion 18. Moreover, the first flat portion 18*a* has a seat 19 where a flat plug (not shown) can be mounted e.g. by snap-fitting in order to hide the screw heads and the openings 18*d*. The rail element 20 is fastened to the panel 6 or 8 by means of screws, and for its correct initial positioning a self-adhesive tape (not shown) may be used during the assembly of the built-in appliance.

Alternatively, the sliding element 18 may be fastened to the door 12 also by using its second vertical portion 18*b* which, in this case, will be provided with holes (not shown) for fastening screws.

Figure 5:
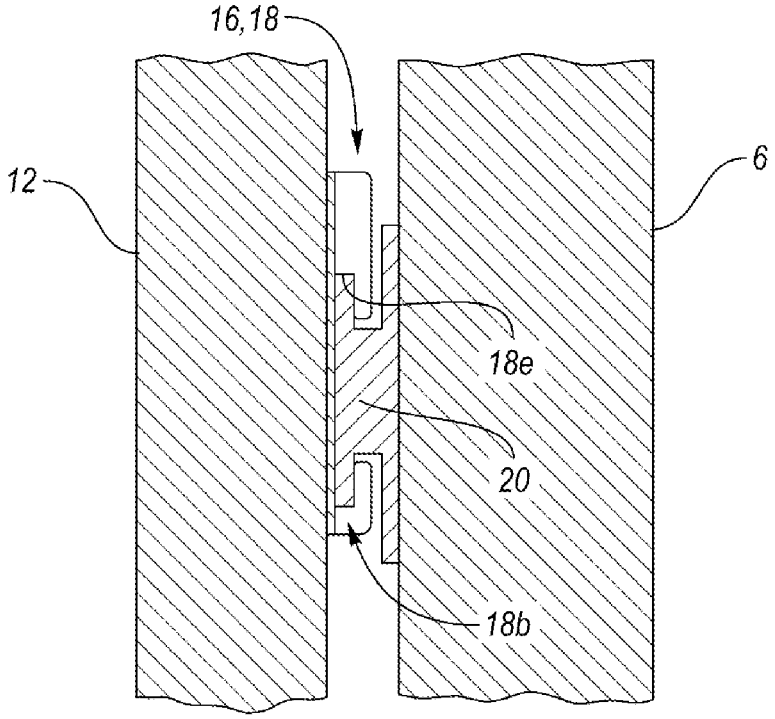
FIG. 5 is a cross-sectional view taken along line IV-IV in FIG. 4.
Figure 6:
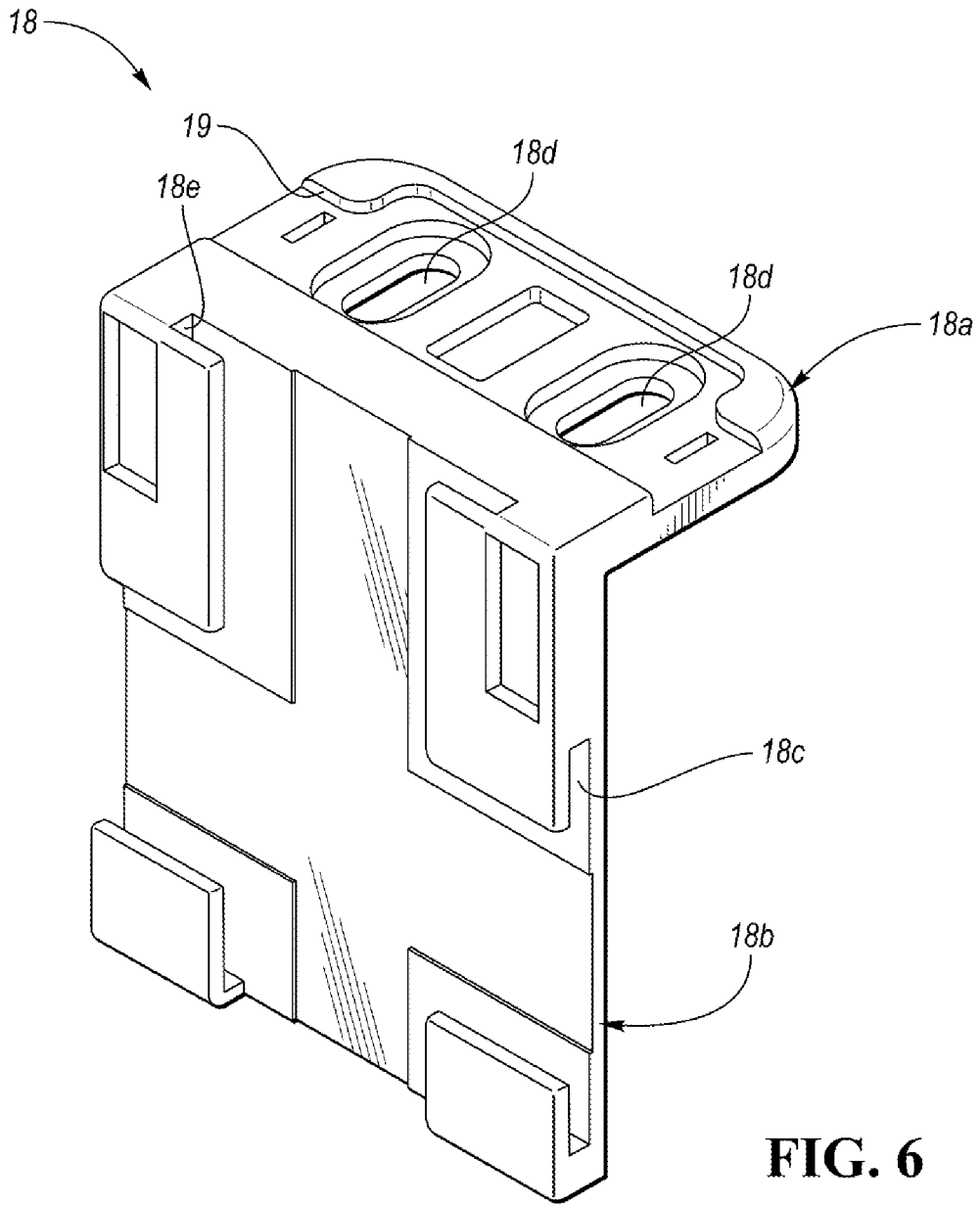
FIG. 6 is a perspective view of the sliding element.

The shape and dimensions of the sliding element 18 (as indicated in FIG. 5) are such that the rail 20 on which it slides is completely interposed between the panel 6 and the door 12 of the appliance, so that in any position of such door 12 during its opening and closing movement, it is totally invisible to the user. What the user can see is only the first flat portion 18*a* of the sliding element 18, which is small and placed in a seat of the upper edge of the door, so that its visibility is very low.

The same kind of sliding connection between the panel and the door of the appliance can be used for the lower panel 8 (freezer) as well. Of course, some variants of this system can be adopted, for instance the sliding and connecting device 16 can be positioned at the upper horizontal edge 12*b* (e.g., the first configuration of the sliding and connecting device 16) or lower edge of the door 12. Also, the shape of the sliding element 18 and of the rail element 20 can be different from what shown in the drawings, and the cross section of the rail 20 can be different from the H shape shown in the drawings, for instance it could have a simple T-shaped cross section. Also, the fastening means of the rail element 20 to the panels 6 and 8 could be different from screws. Alternatively, the rail element 20 could be glued to the panel.

It should be understood that the designations of first, second, third, fourth, etc. for any component, state, or condition described herein may be rearranged in the claims so that they are in chronological order with respect to the claims.

The words used in the specification are words of description rather than limitation, and it is understood that various changes may be made without departing from the spirit and scope of the disclosure. As previously described, the features of various embodiments may be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics may be compromised to achieve desired overall system attributes, which depend on the specific application and implementation. As such, embodiments described as less desirable than other embodiments or prior art implementations with respect to one or more characteristics are not outside the scope of the disclosure and may be desirable for particular applications.

What is claimed is:

1. A built-in assembly comprising:

a refrigerating appliance having a door;

a piece of furniture having a cabinet structure and a front panel hinged to the cabinet structure, wherein the cabinet structure is configured to receive the refrigerating appliance, and wherein the front panel is arranged adjacent to the door of the refrigerating appliance;

at least one first sliding and connecting device slidably securing the front panel to the door, wherein the at least one first sliding and connecting device comprises a first rail element and a first sliding element, wherein (i) the first sliding element has a first flat portion fastened to a horizontal edge of the door, (ii) the first sliding element has a second flat portion having opposing inner and outer surfaces, (iii) the inner surface is secured to a front surface of the door, (iv) the outer surface defines a first channel and a second channel intersecting the first channel, (v) each of the first and second channels are sized to receive the first rail element, (vi) the first rail element is disposed within the first channel such that the first sliding element slidably engages the first rail element, and (vii) the first rail element is fastened to the front panel; and at least one second sliding and connecting device slidably securing the front panel to the door, wherein the at one least second sliding and connecting device comprises a second rail element and a second sliding element, wherein (i) the first rail element is substantially parallel with the second rail element, (ii) the first sliding element is substantially perpendicular to the second sliding element, (iii) the second sliding element has a third flat portion fastened to a vertical side edge of the door, (iv) the second sliding element has a fourth flat portion having opposing second inner and outer surfaces, (v) the second inner surface is secured to the front surface of the door, (vi) the second outer surface defines a third channel and a fourth channel intersecting the third channel, (vii) each of the third and fourth channels are sized to receive the second rail element, (viii) the second rail element is disposed within the fourth channel such that the second sliding element slidably engages the second rail element, and (ix) the second rail element is fastened to the front panel.

2. The built-in assembly of claim 1 wherein the second flat portion has a C-shaped cross section hollow profile that is configured to engage and slide along a matching H-shaped cross section profile formed on the first rail element.

3. The built-in assembly of claim 2, wherein the first sliding element is L-shaped, and wherein the second flat portion is fully interposed between the front panel and the door such that it is hidden from view.

4. The built-in assembly of claim 3, wherein the horizontal edge of the door defines a seat configured to receive the first flat portion of the first sliding element such that the first flat portion substantially flush with the horizontal edge of the door.

5. The built-in assembly of claim 4, wherein the first flat portion of the first sliding element defines a seat configured to receive a flat plug to hide fastening means.

6. The built-in assembly of claim 1, wherein the second sliding element is L-shaped, and wherein the fourth flat portion is fully interposed between the front panel and the door such that it is hidden from view.

7. The built-in assembly of claim 6, wherein the vertical side edge of the door defines a seat configured to receive the third flat portion of the second sliding element such that the third flat portion substantially flush with the vertical side edge of the door.

8. The built-in assembly of claim 1, wherein the first and second sliding elements are identical and interchangeable.

9. The built-in assembly of claim 1, wherein (i) the first and second channels are substantially perpendicular to each other and (ii) the third and fourth channels are substantially perpendicular to each other.

10. A built-in assembly comprising:

a refrigerating appliance having a door;

a piece of furniture having a cabinet structure and a front panel hinged to the cabinet structure, wherein the refrigerating appliance is configured for installation in the cabinet structure, and wherein the front panel is arranged adjacent to the door of the refrigerating appliance; and at least one sliding and connecting device comprising a rail element and a sliding element, wherein (i) the sliding element has a first flat portion configured to be fastened to a vertical side edge of the refrigerating appliance door, (ii) the sliding element has a second flat portion configured to cooperate with the rail element, (iii) the second flat portion having opposing inner and outer surfaces, (iv) the inner surface is secured to a front surface of the door, (v) the outer surface defines a first channel and a second channel intersecting the first channel, (vi) each of the first and second channels are sized to receive the first rail element, (vii) the first rail element is disposed within the first channel such that the first sliding element slidably engages the first rail element, (viii) the first rail element is fastened to the front panel, and (ix) the second flat portion is fully interposed between the door and the front panel such that it is hidden from view.

11. The built-in assembly of claim 10, wherein the second flat portion has a C-shaped cross section hollow profile that is configured to engage and slide along a matching H-shaped cross section profile formed on the rail element.

12. The built-in assembly of claim 10, wherein the sliding element is L-shaped.

13. The built-in assembly of claim 10, wherein the first and second channels are substantially perpendicular to each other.

14. The built-in assembly of claim 10 further comprising at least one second sliding and connecting device comprising a second rail element and a second sliding element, wherein (i) the second sliding element has a third flat portion configured to be fastened to a horizontal edge of the refrigerating appliance door, (ii) the second sliding element has a fourth flat portion configured to cooperate with the second rail element, (iii) the third flat portion having opposing second inner and outer surfaces, (iv) the second inner surface is secured to the front surface of the door, (v) the second outer surface defines a third channel and a fourth channel intersecting the first channel, (vi) each of the third and fourth channels are sized to receive the second rail element, (vii) the second rail element is disposed within the fourth channel such that the second sliding element slidably engages the second rail element, (viii) the second rail element is fastened to the front panel, and (ix) the fourth flat portion is fully interposed between the door and the front panel such that it is hidden from view.

15. The built-in assembly of claim 14, wherein the fourth flat portion has a C-shaped cross section hollow profile that is configured to engage and slide along a matching H-shaped cross section profile formed on the second rail element.

16. The built-in assembly of claim 14, wherein the second sliding element is L-shaped.

17. The built-in assembly of claim 14, wherein the first and second sliding elements are identical and interchangeable.

18. The built-in assembly of claim 14, wherein the third and fourth channels are substantially perpendicular to each other.

19. A built-in assembly comprising:

a refrigerating appliance having a door;

a piece of furniture having a cabinet structure and a front panel hinged to the cabinet structure, wherein the refrigerating appliance is configured for installation in the cabinet structure, and wherein the front panel is arranged adjacent to the door of the refrigerating appliance; and at least one sliding and connecting device having a rail element and a sliding element, and configured to slidably secure the front panel to the door, wherein the sliding element has (i) a first flat portion configured to be fastened to a horizontal edge or a vertical side edge of the refrigerating appliance door and (ii) a second flat portion having a first C-shaped cross section hollow profile and a second C-shaped cross section hollow profile intersecting the first C-shaped cross section hollow profile, and wherein each of the first and second C-shaped cross section hollow profiles are configured to engage and slide along a matching H-shaped cross section profile formed on the rail element.

20. The built-in assembly of claim 19, wherein the first C-shaped cross section hollow profile and second C-shaped cross section hollow profile are substantially perpendicular to each other.

* * * * *